United States Patent [19]

Lean et al.

[11] Patent Number: 4,596,479

[45] Date of Patent: Jun. 24, 1986

[54] DOT MATRIX PRINTER

[75] Inventors: Eric G. Lean, Chappaqua; Keith S. Pennington, Somers; Samuel C. Tseng, Pleasantville; Han C. Wang, Chappaqua, all of N.Y.

[73] Assignee: International Business Machines Corporation, Armonk, N.Y.

[21] Appl. No.: 734,746

[22] Filed: May 15, 1985

Related U.S. Application Data

[63] Continuation of Ser. No. 601,750, Apr. 23, 1984, abandoned, which is a continuation of Ser. No. 394,017, Jun. 30, 1982, abandoned.

[51] Int. Cl.[4] ..... B41J 3/10

[52] U.S. Cl. ..... 400/121; 101/93.05; 101/93.14; 400/146

[58] Field of Search ..... 400/121, 146; 101/93.04, 93.09, 93.13, 93.14; 178/30; 346/141

[56] References Cited

U.S. PATENT DOCUMENTS

| | | | |
|---|---|---|---|
| 3,283,702 | 11/1966 | Higgins et al. | 101/93.04 |
| 3,286,625 | 11/1966 | Petit | 101/93 |
| 3,303,775 | 2/1967 | Giannuzzi | 101/93 |
| 3,550,148 | 12/1970 | Machler | 400/121 X |
| 3,742,845 | 7/1973 | Giani | 101/93.14 X |
| 3,884,148 | 5/1975 | Bergeron | 101/426 |
| 4,102,268 | 7/1978 | Guarderas et al. | 101/399 |
| 4,230,039 | 10/1980 | Mizutani et al. | 101/93.17 |

FOREIGN PATENT DOCUMENTS

| | | | |
|---|---|---|---|
| 0043434 | 1/1982 | European Pat. Off. | 101/93.04 |
| 2065 | 1/1980 | Japan | 101/93.04 |
| 7507826 | 1/1976 | Netherlands | 101/93.04 |
| 1493719 | 11/1977 | United Kingdom | 101/93.04 |

OTHER PUBLICATIONS

*IBM Tech. Disc. Bulletin*, by A. F. Higginbotham, vol. 22, No. 10, Mar. 1980, pp. 4345–4347.

*IBM Tech. Disc. Bulletin*, by K. P. Eswaran et al., vol. 21, No. 5, Oct. 1978, p. 2000.

*Primary Examiner*—Paul T. Sewell

*Attorney, Agent, or Firm*—B. A. McDowell; M. A. Block

[57] ABSTRACT

The present invention relates to a dot matrix printer which makes use of multiple dot patterns distributed on the cylinder, belt, hand or drum of a line printer to provide an improved printing throughput for an all addressable line printer. In a dot-helix matrix printer, different arrangements of the dots are used which can be varied in position and spacing to increase printing speed. On a belt, band or drum line printer, multiple dot patterns are given a predetermined distribution. More specifically, arrangements of dots are used which provide enhanced performance due to the fact that they are determined by an analysis of the statistical occurrence of a particular dot pattern in a character set. The higher statistical probability dot patterns are used more often on the belt, band or drum.

16 Claims, 13 Drawing Figures

DOT MATRIX PRINTER

This is a continuation of application Ser. No. 601,750, filed Apr. 23, 1984, now abandoned, which in turn is a continuation of application Ser. No. 394,017, filed Jun. 30, 1982, now abandoned.

FIELD OF THE INVENTION

This invention relates to impact printing and in particular to impact line printers which employ dot patterns in the printing operation to record dots on a print medium to form characters, images, symbols, lines or the like.

BACKGROUND OF THE INVENTION

Dot matrix printers may be of various diverse types, such as, helical printers and band printers. A dot-helix matrix printer, which is an enhancement of the bar-helix printer, consists of a rotating cylinder having rows of single raised dot print elements formed in a helical pattern around the peripheral surface. A plurality of print hammers having a bar-shaped impact surface is provided. A paper print medium is continuously fed between the hammers and the cylinder. Actuators are provided which selectively actuate the hammers to strike the dot print elements against an ink ribbon and paper whenever one of the dot elements is in position to be printed to record printed dots on the paper.

Band matrix printers employ a single set of raised dots distributed along a band or belt which moves horizontally across the paper to be printed. Another form is a drum printer which has raised dots distributed in columns around a drum which rotates around an axes parallel to the line to be printed. In both cases, printing is achieved by impacting the raised dot printing elements with a print hammer which results in the raised dots impacting a printing ribbon against paper and transferring ink or printing dots at the position of the dots when the paper is contacted. Patterns are printed by striking the hammers against the printing belt or drum whenever one of the dot printing elements, which move along the printing line, is in a position where a printed dot is desired. In this way, any desired pattern is formed by an array of dots which are printed along a line. Subsequent lines are printed by stepping the paper vertically or normal to the printing line.

It is well known that one limitation on the printing speed of impact printers such as impact line printers is the cycle time of the print hammer or maximum repetition rate of the pattern of the print elements on a dot-helix cylinder or on a belt, band or drum. It became apparent that it would be advantageous if the printer throughput could be improved for a given hammer repetition rate.

SUMMARY OF THE INVENTION

The present invention makes use of multiple dot patterns distributed on the cylinder, belt, band or drum of a line printer to provide an improved printing throughput for an all points addressable line printer.

In a dot-helix matrix printer, different arrangements of the dots are used which can be varied in position and spacing to increase printing speed. By using a 1, 2, 1, 2, dot pattern, a 66% printing speed and a 33% power saving is realized over the use of a single dot pattern. The use of a 1, 2, 1, 3, dot pattern results in a speed improvement of 100% over the single dot pattern.

On a belt, band or drum line printer, multiple dot patterns are given a predetermined distribution. More specifically, arrangements of dots are used which provide enhanced performance due to the fact that they are determined by an analysis of the statistical occurence of a particular dot pattern in a character set. The higher statistical probability dot patterns are used more often on the belt, band or drum. For example, assume pattern 1 consists of a dot in the upper case position, pattern 2 consists of a dot in the lower case position and pattern 3 consists of dots in both the upper and lower case positions. If it is found that, for the character set for a particular application, pattern 1 occurs statistically more often than the other two patterns, then pattern 1 can be used more often and distributed in more places on the belt, band or drum.

The above-described example included a pattern with two rows ($m=2$) and one column ($n=1$) with three possible patterns. The general case for any number of rows and columns is $2^{mn}-1$ possible patterns. The particular patterns that are used and distributed more often will depend on a statistical analysis of whatever character set is to be employed.

Accordingly, a primary object of the present invention is to provide a novel and improved dot matrix printer.

Another object of the present invention is to provide a printer system having a plurality of separate dot pattern marking elements to form a character set and means for distributing the marking elements on a printer according to a predetermined distribution arrangement.

A further object of the present invention is to provide a matrix printer having a helical array of embossed patterns of dots on a cylinder wherein different arrangements of the dots can be used which are varied in position and spacing to increase the printing speed.

A still further object of the present invention is to provide a matrix printer which makes use of a band, belt or drum on which particular patterns of embossed dots are used and distributed more often depending on a statistical analysis of whatever character set is to be employed.

The foregoing and other objects, features and advantages of the invention will be apparent from the following more particular description of preferred embodiments of the invention, as illustrated in the accompanying drawings.

DESCRIPTION OF PREFERRED EMBODIMENTS

Figure 1:
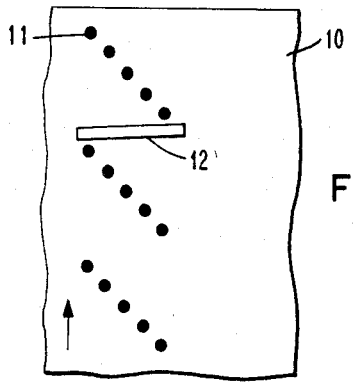
FIG. 1 is a diagrammatic view showing a basic single dot pattern arranged in a helical array on a cylinder of a dot-helix matrix printer.

Referring to FIG. 1, there is illustrated a rotating cylinder 10 of a dot-helix matrix printer. A row of single raised dot print elements 11 is shown formed in a helical pattern around the peripheral surface of the cylinder. A plurality of similar rows would be disposed along the cylinder, there being one row for each character print position. A print hammer 12 having a bar-shaped impact surface is provided for each row of dot print elements. It is not shown, but it is well known that a paper print medium is continuously fed vertically between the rotating cylinder and print hammers. Magnetically operated actuators are provided which selectively actuate the hammers to strike the dot print elements against an ink ribbon and paper whenever one of the dot elements is in position to be printed to record printed dots on the paper.

Figure 2:
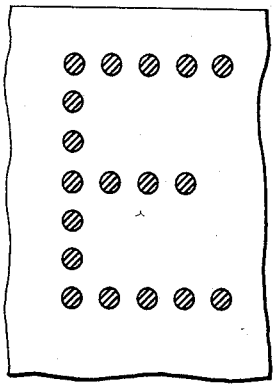
FIG. 2 is a diagrammatic view showing the dot matrix arrangement for the printed character "E".

Taking the basic dot pattern shown in FIG. 1, assume the print hammers repetition rate is fixed at 1 ms. and the vertical spacing between dots is 0.020 inches and the cylinder is rotating at a surface speed of 20 in./sec. For a 5 by 7 character printing, it takes 6 ms to complete a horizontal row of dots and 42 ms. to print a character. There are 5 dots per character and 1 dot spacing between characters. To print a 5 by 7 character "E", shown in FIG. 2, will require the hammer to strike 18 times.

Figure 3:
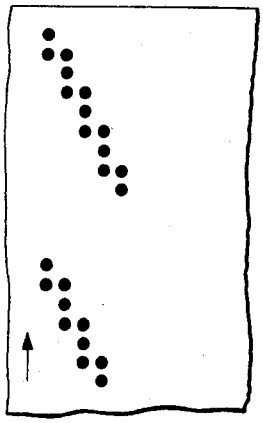
FIG. 3 is a diagrammatic view showing a 1, 2, 1, 2, dot pattern arranged in a helical array on the cylinder of FIG. 1.

In accordance with the present invention, by arranging different dot patterns on the cylinder, the printing speed and power consumption can be improved. One example is shown in FIG. 3 wherein the dot elements are disposed in a 1, 2, 1, 2, arrangement. The vertical spacing between dots is maintained at 0.020 inches. With the hammer repetition rate fixed at 1 ms. and the cylinder now rotating at a surface speed of 60 in./sec., the dot pattern is so arranged that the hammer is never required to strike within 3 rows of dots (1 ms.). To print a 5 dot row now requires 4 ms. instead of 6 ms., as is the case for the pattern shown in FIG. 1. A printing speed increase of 66% is realized. To print the character "E", shown in FIG. 2, requires only 12 hammer strikes instead of 18. This results in a power saving of 33%.

Figure 4:
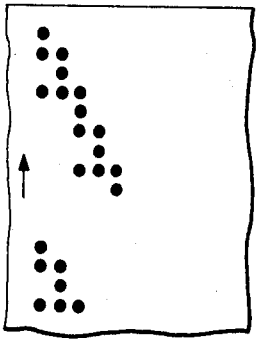
FIG. 4 is a diagrammatic view showing a 1, 2, 1, 3, dot pattern arranged in a helical array on the cylinder of FIG. 1.

The printing speed can be further improved by different arrangements of dot patterns. For example, a 1, 2, 1, 3, pattern is shown in FIG. 4. Assume the same fixed parameters and the cylinder rotating at a speed of 80 in./sec. It now requires only 3 ms. to print a 5 dot line resulting in a 100% speed improvement. To print the character "E", shown in FIG. 2, now requires only 10 hammer strikes. Other designs of dot patterns for different resolutions can achieve similar printing speed improvements.

Figure 5:
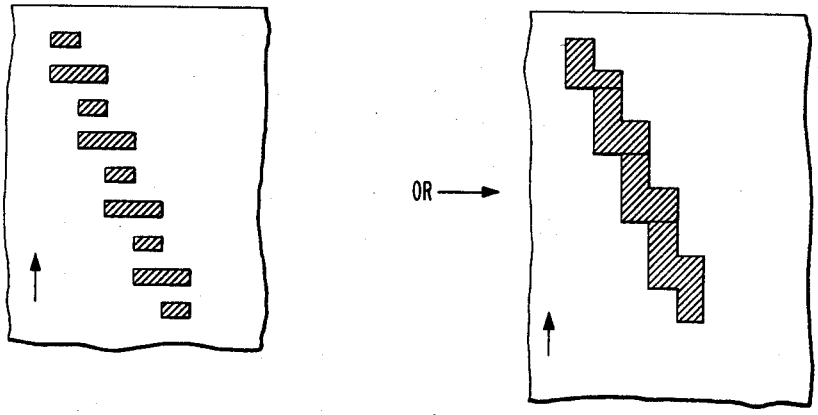
FIG. 5 is a diagrammatic view showing a bar pattern arranged in a helical array on the cylinder of FIG. 1.

It will be understood that the embossed patterns do not have to be in dot form. They can be extended to bar forms to further improve the print quality. The bar pattern shown in FIG. 5 can be used to replace the dot pattern shown in FIG. 3. Solid line printing can be achieved with overlapping dots or bars.

Figure 6:
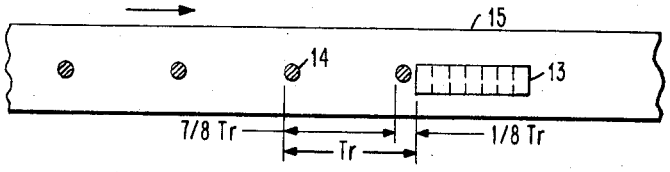
FIG. 6 is a diagrammatic view showing one configuration of a single dot pattern on a belt of a band matrix printer.

In another embodiment of the present invention, multiple dot patterns are distributed on a belt, band or drum of a line printer to provide an improved printing throughput for an all points addressable line printer. Referring to FIG. 6, there is shown one configuration of a "single dot" band printer in which the hammer 13 can strike a single raised dot print element 14 at any one of seven locations across the hammer. The dot print elements are spaced at intervals of eight print positions along the belt 15 so that no two dots are in front of a print hammer simultaneously. The belt moves horizontally across a paper print medium to be printed. Printing is achieved by impacting the raised dot print elements to a printing ribbon against the paper and transferring ink or printing dots at the position of the dots when the paper is contacted. Patterns are printed by selectively energizing magnetic actuators to effect the striking of hammers against the printing belt or drum whenever one of the dot print elements, which move along or across the printing line, is in a position where a printed dot is desired. The number of hammers employed can vary and depends on the number of characters to be printed per line and the spacing between dots. In this way, any desired pattern is formed by an array of dots which are printed along a line. Subsequent lines are printed by stepping the paper vertically or normal to the printing line.

Figure 7:
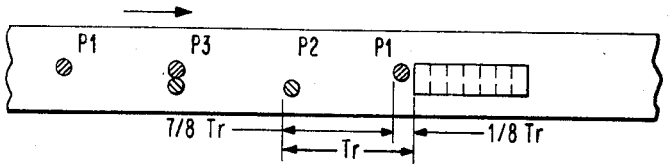
FIG. 7 is a diagrammatic view showing one configuration of a vertical multidot pattern arrangement on a belt of a band matrix printer.
Figure 8:
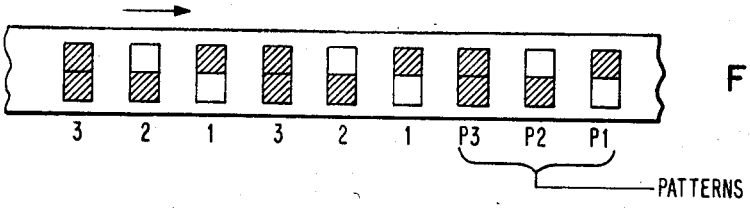
FIG. 8 is a diagrammatic view illustrating the 3 vertical dot patterns shown in the arrangement of FIG. 7.

Referring to FIG. 7, there is shown a simple multidot belt pattern for the case m=2, n=1, where m corresponds to the number of rows and n the number of columns in the dot patterns distributed around the belt. This pattern comprises dot P1 in the upper case position, dot P2 in the lower case position, and dots P3 in both the upper and lower case positions. FIG. 8 shows the same pattern in shaded square form for purposes of illustration. P1, P2 and P3 would be arranged around the belt as shown.

In order to print a line of characters where each character consists of dots printed on an MxN matrix and the print elements consist of dots distributed on an mxn matrix the printing time is given by $$T=S\times(M/m)\times(N/n)\times T_r+(M/m)\times T_p$$

where $T_r$=Hammer repetition rate $T_p$=Paper advancing time

S=A function which varies dependent on the initial position of the dot patterns relative to the printed information.

The factor S is unity for a single dot pattern and S>1 for a multidot band. It increases the further the initial position of the required dot pattern is from the position to be printed. In order for the printing throughput to be better than the single dot case, it is desirable that (S/mn) decrease to less than one. If this ratio is less than one, the multidot pattern will be definitely better than the single dot pattern. Even if this ratio is not less than one, if the (M/n) $T_p$ term reduces the paper advance time to the extent that the total time is less, then the multidot pattern is still better than the single dot case. The factor S reduces if the belt speed is higher or if the statistics for the multidot patterns are skewed. The latter is the essence of the present invention, as described later.

Considering the printing of an alphanumeric character set as a 8×7 matrix with a single dot band and a 3-patterns or m=2, n=1 band under conditions of $T_r$=1 msec and $T_p$=5 msec. The single dot band requires 56 msec for the printing operation and 40 msec to advance the paper, for a total printing time of 96 msec.

Now for the multidot case with m=2, n=1, the average printing speed for all characters of the alphanumeric set is 43.424 msec. This results in an average improvement 54.7%. However, it is realized that this printing speed improvement requires an eight fold increase in the belt speed but an overall decrease in the number of actual hammer firings per printed job. Further increase in the belt speed will further increase the print throughput. The essence is that even if the belt speed is increased, the throughput will not increase for the single dot belt.

The approach described above is an extension of the single dot band (belt, drum) printing concept to multidot elements. What follows, however, is a general description of methods which can be employed to produce further overall printing throughput increases. Methods which involve the use of the statistics related to the desired printed character set, the language to be printed and ultimately the type of printing jobs. This exposition is not exhaustive, but indicates the methods that are to be employed when designing a multidot printer.

Considering a multidot belt printer as shown in FIGS. 7 and 8, with m=2, n=1, the number of independent patterns on the belt is three. Considering the entire character set described earlier the number of times each pattern occurs is:

P1=231
P2=134
P3=111

Figure 9:
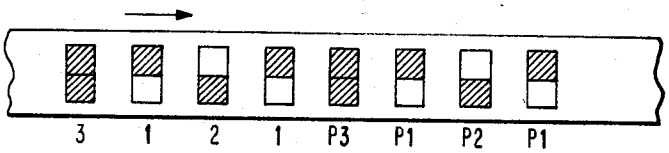
FIG. 9 is a diagrammatic view illustrating the dot patterns shown in the arrangement of FIG. 8 with one of the dot patterns being used more frequently than the others.

It thus appears that for printing the entire alphanumeric set when each character has an equal probability of occurrence, a belt (band or drum) which has a greater number of patterns type P1 than P2 or P3 will give greater printing throughput. Such a pattern is shown in FIG. 9 as P1, P2, P1, P3.

Comparing a multidot printer m=2, n=1 which does not employ the statistical distribution of the patterns involved in the character set with a multidot belt printer which does take into account this fact, there is obtained for a sequential printing operation; i.e., characters printed from left to right, the following printing speeds. Non-statistical belt with three patterns P1, P2, P3 distributed periodically around the belt.

Average print speed: 24.424 msec/character line
Worst case printing speed: 34.125 msec/character lines Statistical belt with patterns distributed P1, P2, P1, P3 cyclically around the belt. The number of cycle of 4 pattern positions is based on the length of the belt.

Average Print Speed: 23.878 msec/character line
Worst Case Print: 34.125 msec/charcter line For random printing, i.c., a pattern is struck as it arrives at the correct printing position (no left to right requirement), the printing speeds become:

Non-statistical belt: 21.47 msec average, 33.75 msec worst case
Statistical Belt: 21.114 msec average, 31.25 msec worst case Further improvement may be possible by considering the fact that not all characters are equally probably used in any language. Also, the relative positions of dot patterns on the belt (in any given dot pattern cycle or between cycles) can influence the overall printing speed through the statistical probability of occurrence (i.e., dependent probabilities) associated with a given dot pattern immediately preceding or following any other dot pattern. Finally any statistical skew that may be associated with a given type of printing operation (e.g., insurance, air lines, payroll, etc.) can also be factored into the statistics of the dot pattern distribution.

Figure 10:
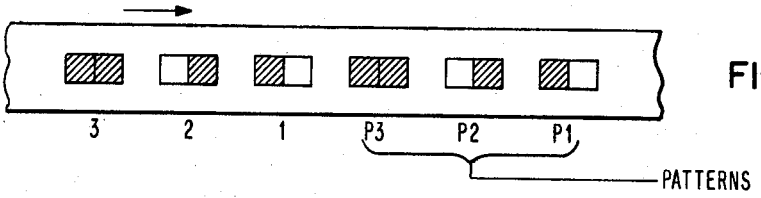
FIG. 10 is a diagrammatic view illustrating a horizontal arrangement of 3 dot patterns on a belt of a band matrix printer.
Figure 11:
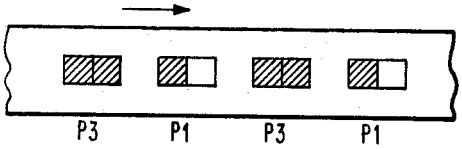
FIG. 11 is a diagrammatic view illustrating a horizontal arrangement of 2 of the dot patterns shown in FIG. 10.
Figure 12:
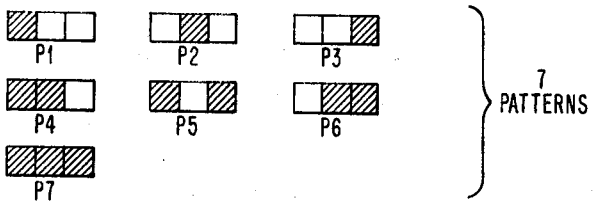
FIG. 12 is a diagrammatic view illustrating 7 dot patterns that could be arranged horizontally on the belt of a band matrix printer.
Figure 13:
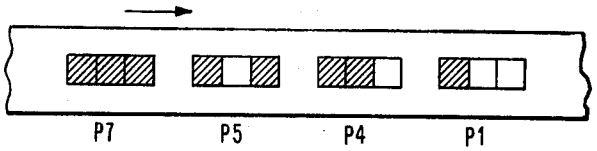
FIG. 13 is a diagrammatic view illustrating a horizontal arrangement of 4 of the dot patterns shown in FIG. 12.

Referring to FIGS. 10–13, patterns are shown distributed in a horizontal row around the belt. In the case of a horizontal distribution, the number of patterns is $2^n-1$. For the case where n=2, there are three patterns P1, P2 and P3, as shown in FIG. 10. However, patterns P1 and P2 are redundant so that only patterns P1 and P3 need be used, as shown in FIG. 11. FIG. 12 illustrates the seven patterns P1–P7 which would be the case where n=3. In this case, patterns 1 and 3, 4 and 6 are redundant and only patterns P1, P4, P5 and P7 need be used, as shown in FIG. 13.

It will be understood that the present invention is not limited to the specific patterns shown and described. These patterns may be varied to meet the requirements of different printing applications.

While the invention has been particularly shown and described with reference to preferred embodiments thereof, it will be understood by those skilled in the art that various changes in form and details may be made therein without departing from the spirit and scope of the invention.

What is claimed is:

1. A multidot printer system for printing an alphanumeric character set, each alphanumeric character comprising a plurality of independent dot patterns, said printer system having a print element carrying member including raised dot print elements forming a dot pattern character set in the form of independent dot patterns distributed around said carrying member, the number of said independent dot patterns being determined by the number of rows and the number of columns in the dot pattern, said independent dot patterns being distributed around said carrying member at a frequency substantially proportional to their statistical probability of occurrence during printing.

2. A multidot printer system according to claim 1 wherein said print element carrying member is a band.

3. A multidot printer system according to claim 1 wherein said print element carrying member is a drum.

4. A multidot printer system as recited in claim 1 wherein said print element carrying member is a belt.

5. A multidot printer system for printing an alphanumeric character set, each alphanumeric character comprising a plurality of independent dot patterns, said printer system having a print element carrying member carrying raised dot print elements distributed in the form of independent dot patterns which are arranged in $2^{nm}-1$ possible patterns where m corresonds to the number of rows and n the number of columns in the distribution of dot patterns, said independent dot patterns being distributed around said carrying member at a frequency substantially proportional to their statistical probability of occurrence during printing.

6. A multidot printer system as recited in claim 5 wherein said print element carrying member is a band.

7. A multidot printer system as recited in claim 5 wherein said print element carrying member is a belt.

8. A multidot printer system as recited in claim 5 wherein said print element carrying member is a drum.

9. A multidot printer system for printing an alphanumeric character set, each alphanumeric character comprising a plurality of independent dot patterns, said printer system having a print element carrying member carrying raised dot print elements distributed in the form of independent dot patterns which are arranged in $2^n-1$ possible patterns where n corresponds to the number of columns in the independent dot patterns, said independent dot patterns being distributed around said carrying member at a frequency substantially proportional to their statistical probability of occurrence during printing.

10. A multidot printer system as recited in claim 9 wherein said print element carrying member is a band.

11. A multidot printer system according to claim 10 wherein none of the dot patterns are redundant.

12. A multidot printer system as recited in claim 9 wherein said print element carrying member is a belt.

13. A multidot printer system as recited in claim 12 wherein none of said dot patterns are redundant.

14. A multidot printer system as recited in claim 9 wherein said print element carrying member is a drum.

15. A multidot printer system as recited in claim 14 wherein none of said dot patterns are redundant.

16. A printer system for printing an alphanumeric character set, each alphanumeric character comprising a plurality of independent dot patterns, said printer system having a rotatable print cylinder with raised dot print elements on the surface thereof, each element comprising three independent dot patterns having one, two, and three dots, respectively, said independent pattern having one dot occurring substantially twice as often during printing as said independent patterns having two or three dots, said dot patterns being distributed in a one dot, two dot, one dot, three dot repeating pattern in rows having a helical arrangement on said cylinder.

* * * * *